United States Patent [19]

Morrissey et al.

[11] Patent Number: 4,927,159

[45] Date of Patent: May 22, 1990

[54] GAME OF HORSESHOES

[76] Inventors: Mark E. Morrissey, Box 7210 Franklin Rd., Evans City, Pa. 16033; Thomas Schiemer, Jr., 47 Hempstead Ave., Pittsburgh, Pa. 15229

[21] Appl. No.: 400,083

[22] Filed: Aug. 29, 1989

[51] Int. Cl.[5] ..... A63B 67/06

[52] U.S. Cl. ..... 273/338; 273/427

[58] Field of Search ..... 273/336, 338, 337, 427, 273/339; 434/250

[56] References Cited

U.S. PATENT DOCUMENTS

| | | | |
|---|---|---|---|
| 1,098,872 | 6/1914 | Akerberg | 273/336 |
| 1,178,049 | 4/1916 | Beardsley | 273/336 |
| 1,541,897 | 6/1925 | Buedingen | 273/336 |
| 1,815,443 | 7/1931 | Mitchell | 434/250 |
| 2,506,815 | 9/1950 | Shaffer | 273/427 X |

*Primary Examiner*—William H. Grieb

*Attorney, Agent, or Firm*—H. Jay Spiegel

[57] ABSTRACT

The present invention relates to the new and improved method of playing a game of horseshoes. The object of the inventive game is to toss horseshoes at the feet of an opponent such that the feet act as the target for scoring points during playing the game of horseshoes.

8 Claims, 2 Drawing Sheets

GAME OF HORSESHOES

BACKGROUND OF THE INVENTION

The present invention relates to a new and improved method of playing the game of horseshoes. The object of the inventive game is to toss horseshoes at the feet of an opponent such that their feet act as the target for scoring points in the game. Of course, playing the game of horseshoes is well known in the prior art. However, applicant is unaware of any prior art that teaches or suggests all of the features of the present invention, including the use of an opponent's feet as the target in the game of horseshoes. The following prior is known to applicant:

U.S. Pat. No. 1,178,049 to Beardsley discloses the concept of an indoor horseshoe game using a resilient target and horseshoe forms made out of a soft material. This is different from the teachings of the present invention in that Beardsley does not teach using as a target the feet of an opponent as is the case in the present invention.

U.S. Pat. No. 1,541,897 to Buedingen and U.S. Pat. No. 1,098,872 to Akerberg are further examples of playing the game of horseshoes using soft materials for the horseshoes. However, neither of these patents teach the concept of playing the game of horseshoes utilizing an opponent's feet as the target for tossing horseshoes thereat or utilizing markers to position the opponent's feet in a proper spaced relationship to play the game of horseshoes as does the present invention.

SUMMARY OF THE INVENTION

The present invention relates to a new and improved method of playing the game of horseshoes. The present invention includes the following interrelated aspects and features:

(a) In a first aspect, the object of the inventive game is to toss horseshoes at the feet of an opponent rather than at stakes, pins or posts in an attempt to score points.

(b) The horseshoes may be made of any soft material that would not be injurious to an opponent during playing of the game.

(c) In playing the game, the opponent's feet may be positioned at the proper distance from a horseshoe tosser by means such as markers or the like so that the opponent cannot move his feet during play. The markers may be in different shapes and may include indicia thereon to indicate which marker is for which foot.

Accordingly, it is a first object of the present invention to provide a new and improved method of playing the game of horseshoes.

It is a further object of the present invention to provide a new and improved game of horseshoes wherein an opponent's feet are used as the target for tossing horseshoes thereat.

It is a yet further object of the present invention to provide markers to position the opponent's feet in the proper location for playing the inventive game.

These and other objects, aspects and features of the present invention will be better understood from the following detailed description of the preferred embodiment when read in conjunction with the appended drawing figure.

SPECIFIC DESCRIPTION OF THE PREFERRED EMBODIMENTS

Figure 1:
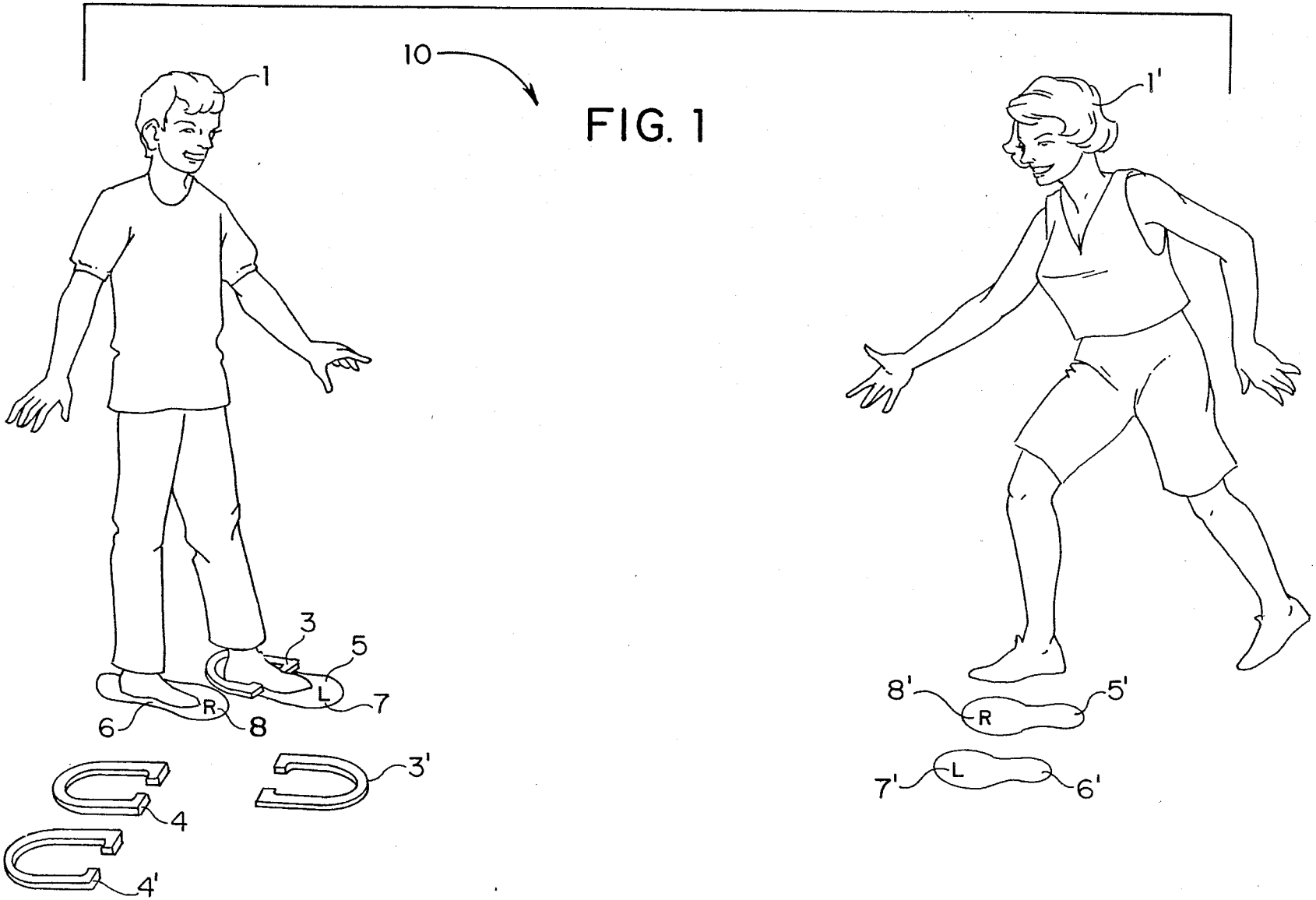
FIG. 1 shows an exemplary mode of playing the game of the present invention.

With reference to FIG. 1, an exemplary mode of the game of the present invention is generally designated by reference numeral 10 and is seen to include two players, 1 and 1', playing the improved game of horseshoes. As can be seen from FIG. 1, player 1' has tossed horseshoes 3 and 3' at the feet of player 1. Player 1 has located himself the proper distance from player 1' by placement of markers 5 and 6 underneath the feet of player 1. Markers 5 and 6 are depicted with indicia 7 and 8 indicating a marker for the left foot and right foot, respectively, of player 1. Also shown in the FIG. 1 are a pair of horseshoes 4 and 4' and a pair of markers 5' and 6' having indicia 7' and 8' thereon to be utilized by player 1' when player 1 is tossing horseshoes at the feet of player 1'. FIG. 1 also depicts a mode of scoring points in the game of horseshoes as shown by horseshoe 3 encircling the foot of player 1, such a configuration generally known as a "ringer" in the game of horseshoes.

Figure 2:
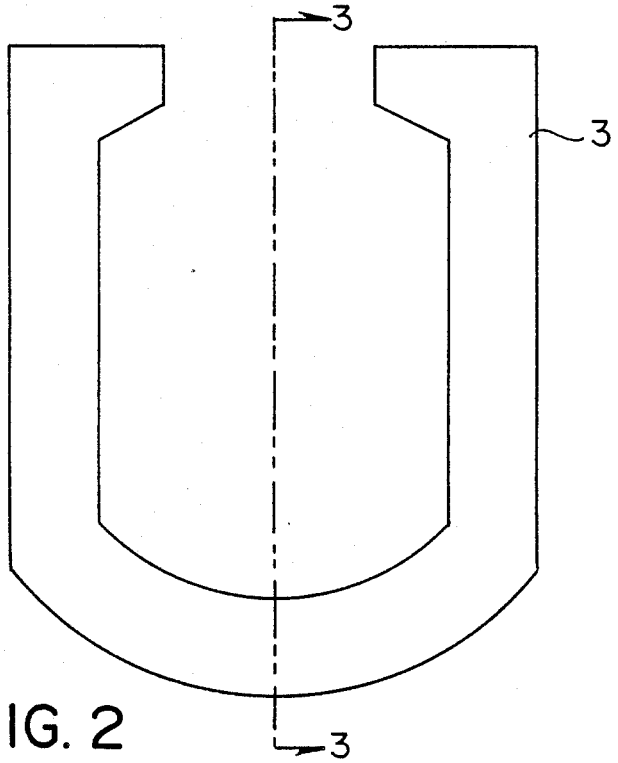
FIG. 2 shows a top view of a horseshoe used in the inventive game.
Figure 3:
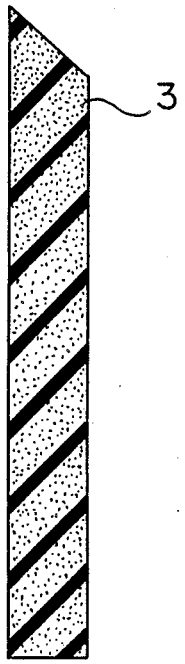
FIG. 3 shows a cross-sectional view along the line 3—3 of FIG. 2.

FIG. 2 illustrates a typical horseshoe 3 with FIG. 3 showing a cross-sectional view thereof.

Figure 4:
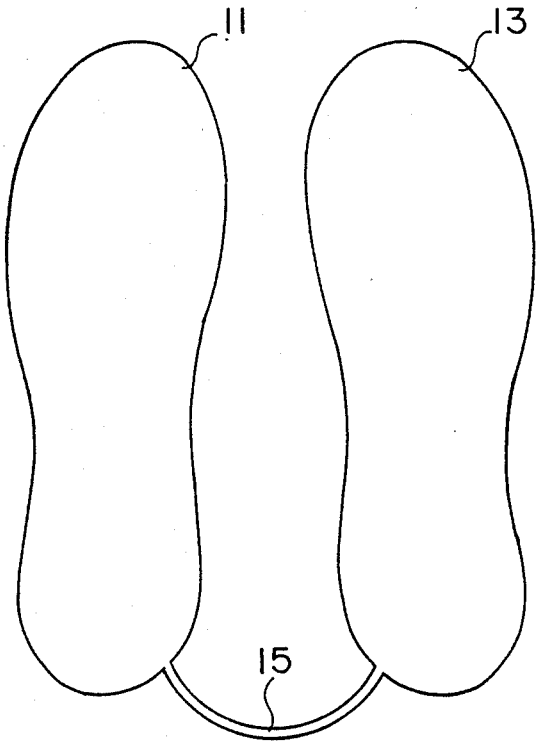
FIG. 4 shows an exemplary embodiment of a marker of the present invention.

With reference to FIG. 4, an exemplary type of marker is illustrated and is generally designated by reference numeral 20 and is seen to include left and right foot markers 11 and 13 connected by member 15. Member 15 assists in properly spacing the markers 11 and 13 from each other during playing of the game.

Figure 5:
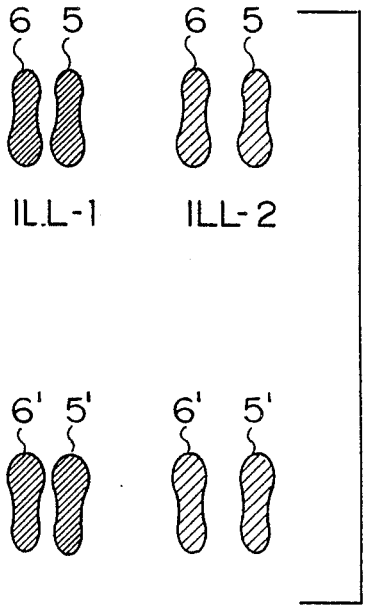
FIG. 5 shows exemplary embodiments of placement of the markers of the inventive game.

FIG. 5 illustrates another exemplary spacing of the markers 5, 5' 6 and 6' as depicted in FIG. 1. ILL-1 of FIG. 5 shows closely spaced markers with ILL.2 depicting markers spaced further apart. Of course, a single marker may be used to position just one foot of an opponent during play. Additionally, other spacings, both between a player's feet as well as between players may be utilized other than the exemplary ones shown in FIG. 5.

The object of the inventive game is for players to alternate tossing horseshoes at the feet of their opponents and scoring points. The game is over after one player reaches a predetermined number of total points.

An exemplary mode of scoring of points may be as follows:

(a) Encircling an opponent player's foot with a horseshoe scores three points;

(b) Leaning a horseshoe against a portion of an opponent's foot scores two points; and (c) Landing a horseshoe within a distance equal to the open end of the horseshoe from a foot of an opposing player scores one point.

Using there point totals for scoring, 21 total points may constitute a winning number of points to end the game. Of course, other point values in conjunction with a given horseshoe position may also be given. Additionally, a different number of predetermined total points may be decided amongst the players prior to starting the game of play to determine who is the winner.

The horseshoes of the inventive game may be made from any soft or resilient material that would not be injurious to any portion of the players, body. Preferred materials include foam rubber or a soft plastic. The horseshoe may also vary in size but a preferred size would include a horseshoe having an opening of sufficient size to enable the horseshoe to encircle a player's ankle, leg or other foot portion. The markers 7 and 8 may also be made of any material such as plastics or rubber compounds.

Although the FIG. 1 only depicts two players participating in the game, teams of players may also compete. For example, teams of two players may compete against each other with players from opposing teams paired together at opposite ends of the playing area. In this arrangement, a player from each team would take a turn at tossing the horseshoes at the feet of an opponent player. Once the horseshoes have been tossed and any points scored have been totalled, the players that had been tossing the horseshoes act as the targets and the other players take their turns at tossing the horseshoes. This team play would continue in the same fashion as described for two players until a winning number of points is reached.

As such, an invention has been disclosed in terms of a preferred embodiment thereof which fulfills each and every one of the objects of the present invention as set forth hereinabove and provides a new and improved game of horseshoes of great utility and novelty.

Of course, many changes, modifications, and alterations in the teachings of the present invention may be contemplated by those skilled in the art without departing from the intended spirit and scope thereof. As such, it is intended that the present invention only be limited by the terms of the appending claims.

I claim:

1. A method of playing a game of horseshoes, between at least a first and second player including the steps of:

(a) providing each said first and second player with at least one pair of horseshoes made from a resilient material each having an opening end;

(b) providing each said first and second player with a marker;

(c) positioning said first player at a predetermined distance from said second player;

(d) placing said marker of said first player underneath a foot of said first player;

(e) commencing playing the game of horseshoes by having said second player toss said horseshoes one at a time at the feet of said first player;

(f) awarding points to said second player by landing said horseshoes in a predetermined location with respect to said first player's feet;

(g) continuing play by repeating steps (d) through (f) wherein said marker of said second player is placed underneath a foot of said second player and said first player tosses said horseshoes at the feet of said second player; and (h) ending play when said first and second players have had the same number of tosses of horseshoes and a predetermined winning number of points have been scored by either said first or second player.

2. The method of claim 1 wherein scoring points is accomplished by either landing a horseshoe around the foot portion of a said first or second player, leaning a horseshoe against a portion of a foot of said first or second player or landing a horseshoe within a distance equal to said open end of said horseshoe from a foot portion of said first player or second player.

3. The method of claim 2 wherein three points are awarded for landing a horseshoe around the foot portion of said first or second player, two points are awarded for leaning a horseshoe against a portion of a foot of said first or second player, and one point is awarded for landing a horseshoe within a distance equal to said open end of said horseshoe from the foot of a said first or second player.

4. The method of claim 1 wherein foam rubber horseshoes are provided to said first and second players.

5. The method of claim 1 wherein said marker is provided having marking indicia thereon.

6. The method of claim 1 wherein said marker is provided being made of a plastic material.

7. An improved game of horseshoes for a plurality of players comprising:

(a) a plurality of horseshoes made of a resilient material; and (b) a plurality of foot shaped markers each adapted to be located under a player's feet and in spaced relationship from an opposing player such that said player's feet act as a target for tossing horseshoes thereat by said opposing player.

8. The invention of claim 7 wherein each said foot shaped marker includes indicia therefor for associating a left or right foot therewith.

* * * * *